US009830864B2

(12) United States Patent
Hada

(10) Patent No.: US 9,830,864 B2
(45) **Date of Patent: *Nov. 28, 2017**

(54) FIELD SEQUENTIAL IMAGE DISPLAY DEVICE

(71) Applicant: NIPPON SEIKI CO., LTD., Niigata (JP)

(72) Inventor: Makoto Hada, Niigata (JP)

(73) Assignee: NIPPON SEIKI CO., LTD., Niigata (JP)

( * ) Notice: Subject to any disclaimer, the term of this patent is extended or adjusted under 35 U.S.C. 154(b) by 95 days.

This patent is subject to a terminal disclaimer.

(21) Appl. No.: 14/408,913

(22) PCT Filed: Jun. 5, 2013

(86) PCT No.: PCT/JP2013/065525

§ 371 (c)(1),
(2) Date: Dec. 17, 2014

(87) PCT Pub. No.: WO2014/007016

PCT Pub. Date: Jan. 9, 2014

(65) Prior Publication Data

US 2015/0194100 A1 Jul. 9, 2015

(30) Foreign Application Priority Data

Jul. 3, 2012 (JP) ..... 2012-149149

(51) Int. Cl.
*G09G 3/34* (2006.01)
*G09G 3/02* (2006.01)

(52) U.S. Cl.
CPC ..... *G09G 3/3413* (2013.01); *G09G 3/025* (2013.01); *G09G 3/346* (2013.01);
(Continued)

(58) Field of Classification Search
CPC ... G09G 2310/0235; G09G 2310/0237; G09G 2320/041; G09G 2320/062;
(Continued)

(56) References Cited

U.S. PATENT DOCUMENTS 5,640,214 A 6/1997 Florence
6,392,620 B1 5/2002 Mizutani et al.
(Continued)

FOREIGN PATENT DOCUMENTS

EP 0 953 960 A1 11/1999
EP 1 091 343 A2 4/2001
(Continued)

OTHER PUBLICATIONS

International Search Report issued in International Application No. PCT/JP2013/065525 dated Jul. 2, 2013.
(Continued)

*Primary Examiner* — Afroza Chowdhury
(74) *Attorney, Agent, or Firm* — McDermott Will & Emery LLP

(57) ABSTRACT

Provided is a field sequential image display device with which the service life of DMD display elements can be lengthened. In the present invention, each frame is equipped with: a display period, wherein a display control portion normally drives multiple mirrors and a lighting control portion drives a first lighting portion and a second lighting portion, thereby displaying a display image in display elements; and a non-display period, wherein the display control portion drives the multiple mirrors for a non-display period and the lighting control portion turns off the first lighting portion and the second lighting portion, and thus the display image is not displayed in the display elements. On the basis of prescribed luminance control conditions, when the luminance of the display image is to be lower than a predeter-
(Continued)

mined threshold luminance value, a control unit lowers the display period ratio, which is the ratio of the display period in each frame period.

7 Claims, 7 Drawing Sheets

(52) U.S. Cl.
CPC ..... *G09G 2310/0235* (2013.01); *G09G 2310/0237* (2013.01); *G09G 2320/041* (2013.01); *G09G 2320/062* (2013.01); *G09G 2320/064* (2013.01)

(58) Field of Classification Search
CPC ..... G09G 2320/064; G09G 3/025; G09G 3/3413; G09G 3/346
See application file for complete search history.

(56) References Cited

U.S. PATENT DOCUMENTS

| | | | | |
|---|---|---|---|---|
| 6,507,330 | B1 | 1/2003 | Handschy et al. | |
| 7,133,022 | B2 | 11/2006 | Grabert | |
| 9,373,285 | B2 * | 6/2016 | Hada | H04N 9/3155 |
| 2002/0030674 | A1 | 3/2002 | Shigeta | |
| 2002/0093480 | A1 * | 7/2002 | Mizutani | G09G 3/3406 345/102 |
| 2003/0132901 | A1 * | 7/2003 | Shimada | G02F 1/133528 345/87 |
| 2007/0070024 | A1 | 3/2007 | Araki et al. | |
| 2007/0241417 | A1 | 10/2007 | Huibers et al. | |
| 2008/0180385 | A1 * | 7/2008 | Yoshida | G09G 3/20 345/102 |
| 2010/0188443 | A1 | 7/2010 | Lewis et al. | |
| 2011/0157477 | A1 * | 6/2011 | Miyata | G09G 3/3611 348/731 |
| 2011/0309925 | A1 | 12/2011 | Ishibashi et al. | |
| 2014/0232763 | A1 * | 8/2014 | Hada | G03B 33/08 345/690 |
| 2015/0130853 | A1 * | 5/2015 | Hada | H04N 9/3155 345/690 |

FOREIGN PATENT DOCUMENTS

| | | | |
|---|---|---|---|
| JP | 3-138691 | B2 | 6/1991 |
| JP | 5-193400 | B2 | 8/1993 |
| JP | 8-195963 | A | 7/1996 |
| JP | 11-338402 | | 12/1999 |
| JP | 2000-200063 | A | 7/2000 |
| JP | 2002-251163 | A | 9/2002 |
| JP | 2003-295156 | A | 10/2003 |
| JP | 2007-122018 | A | 5/2007 |
| JP | 2009-109711 | A | 5/2009 |
| JP | 2011-075637 | A | 4/2011 |
| JP | 2011-242619 | A | 12/2011 |
| JP | 2012-212095 | A | 11/2012 |
| WO | 20111086798 | A1 | 7/2011 |

OTHER PUBLICATIONS

Non-Final Office Action issued in U.S. Appl. No. 14/347,542, dated Feb. 12, 2016.
Final Office Action issued in U.S. Appl. No. 14/347,542, dated Oct. 6, 2016.
Non-Final Office Action issued in U.S. Appl. No. 14/381,469, dated Nov. 6, 2015.
Notice of Allowance issued in U.S. Appl. No. 14/381,469, dated May 6, 2016.
International Search Report issued in Application No. PCT/JP2012/060203, dated May 22, 22.
Extended Search Report issued in corresponding European Patent Applciation No. 12836354.6, dated Apr. 13, 2015.
Extended Search Report issued in corresponding European Patent Applciation No. 13 755 905.0, dated Jul. 10, 2015.
International Search Report issued in Application No. PCT/JP2013/052647, dated Mar. 26, 2013.

* cited by examiner

【Fig.1】
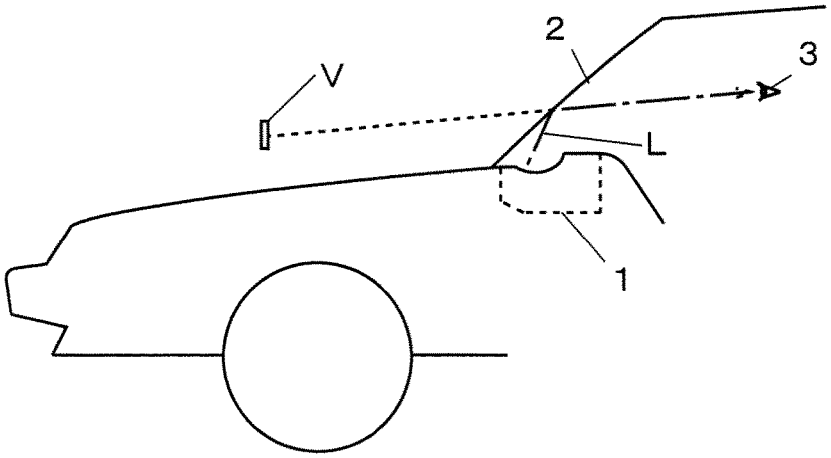
【Fig.2】
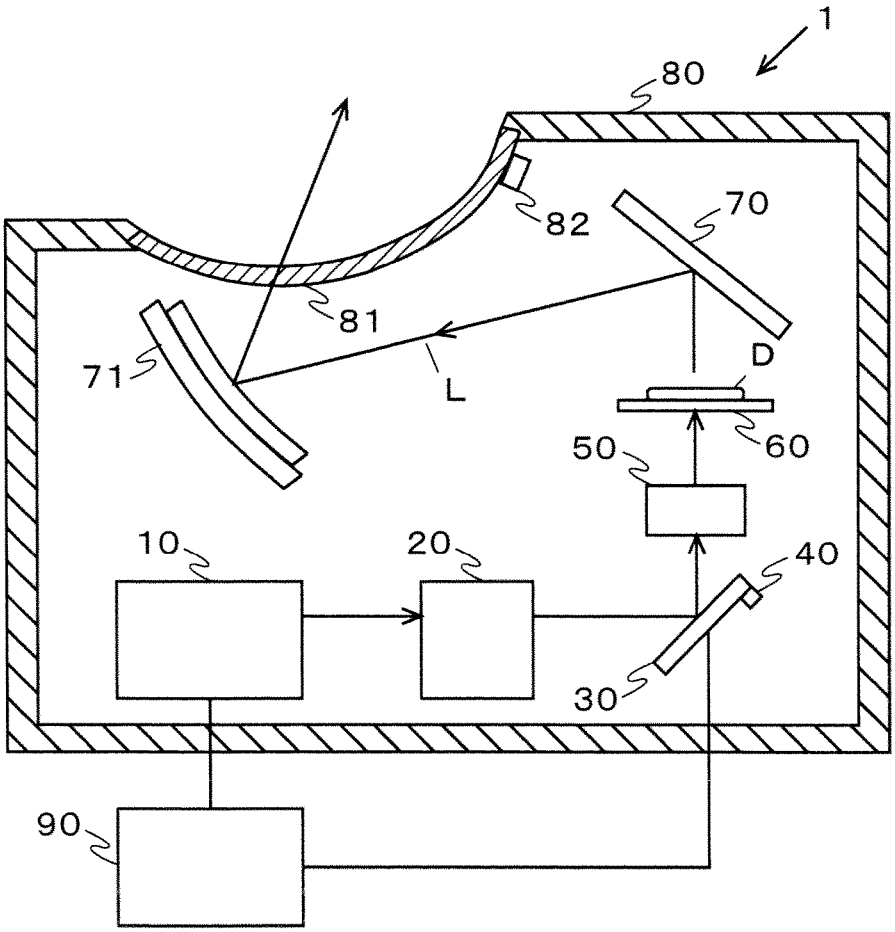

【Fig.3】
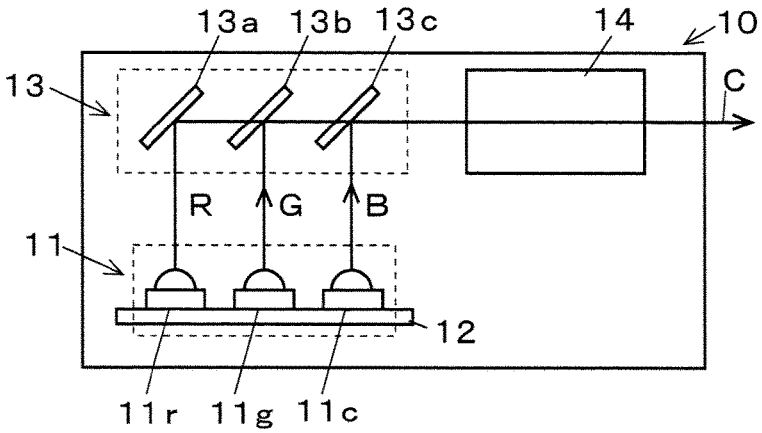
【Fig.4】
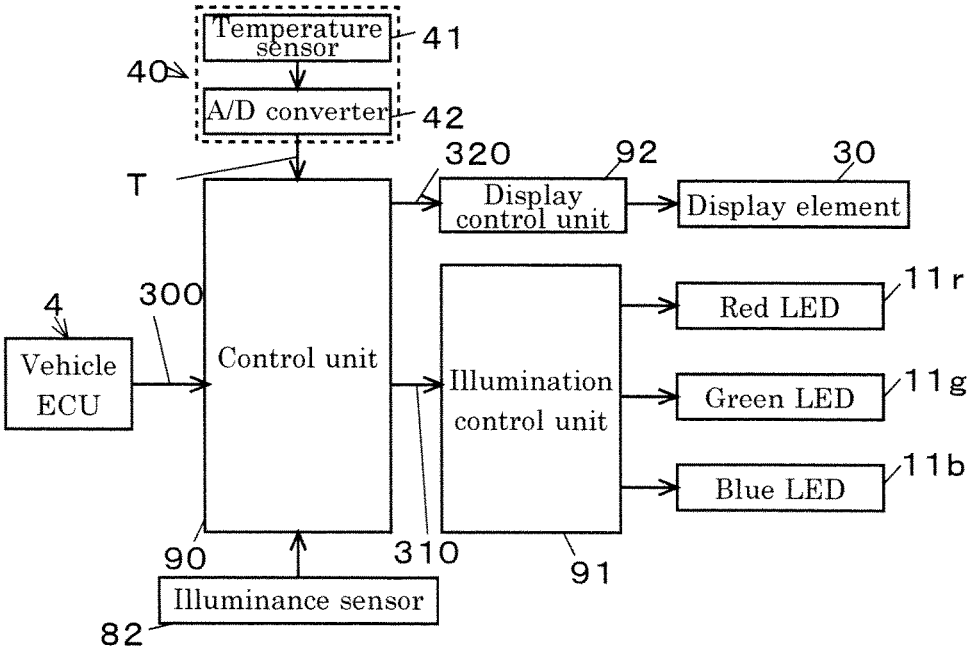

【Fig.5】
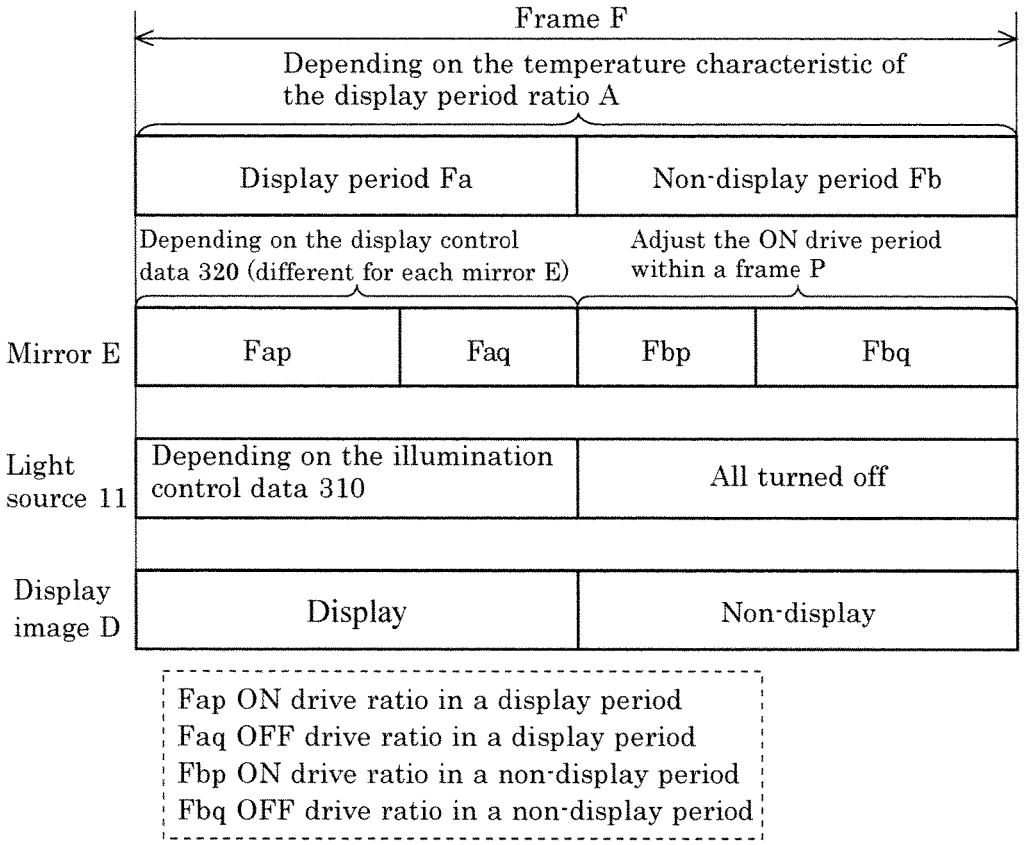

【Fig.6】
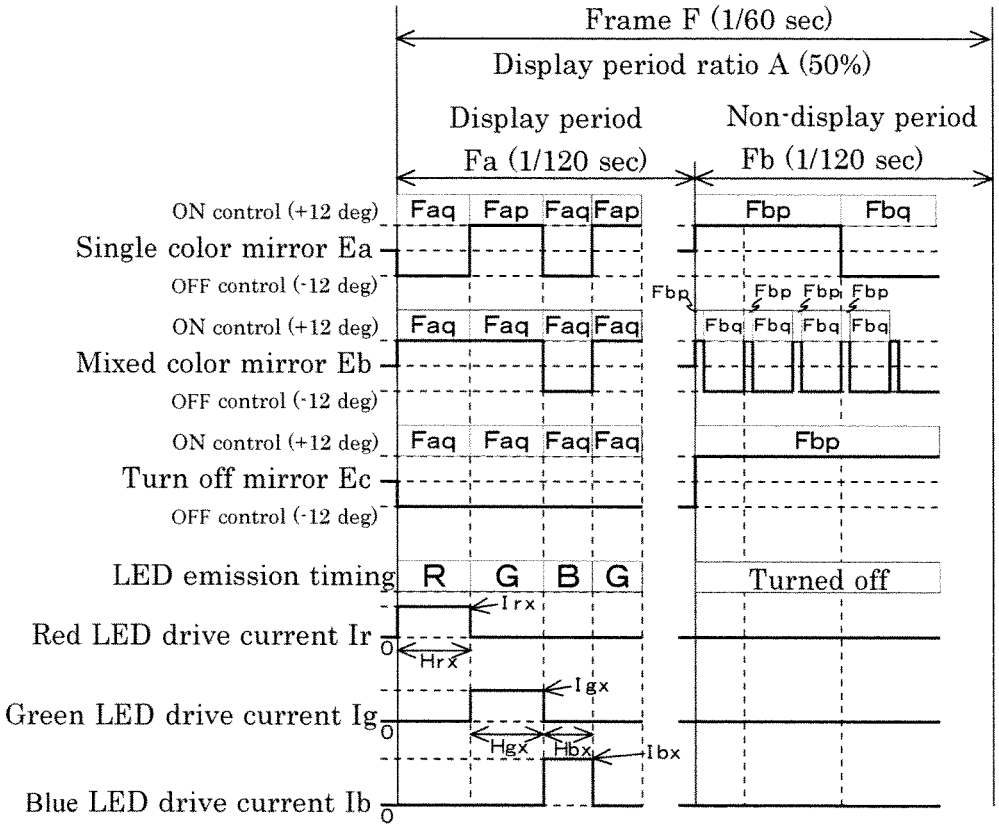
【Fig.7】
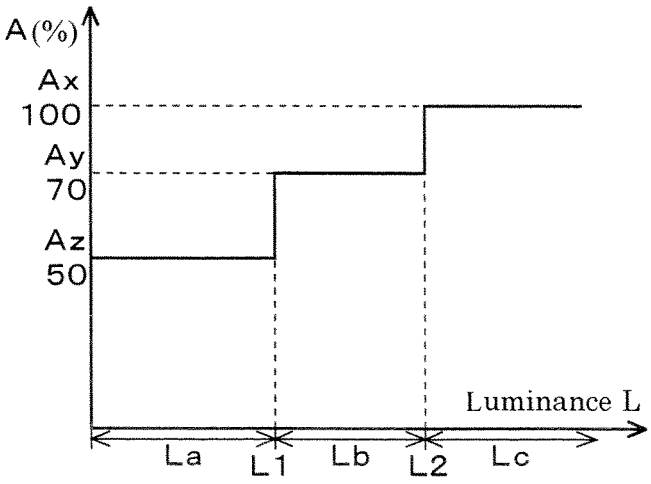

【Fig.8】
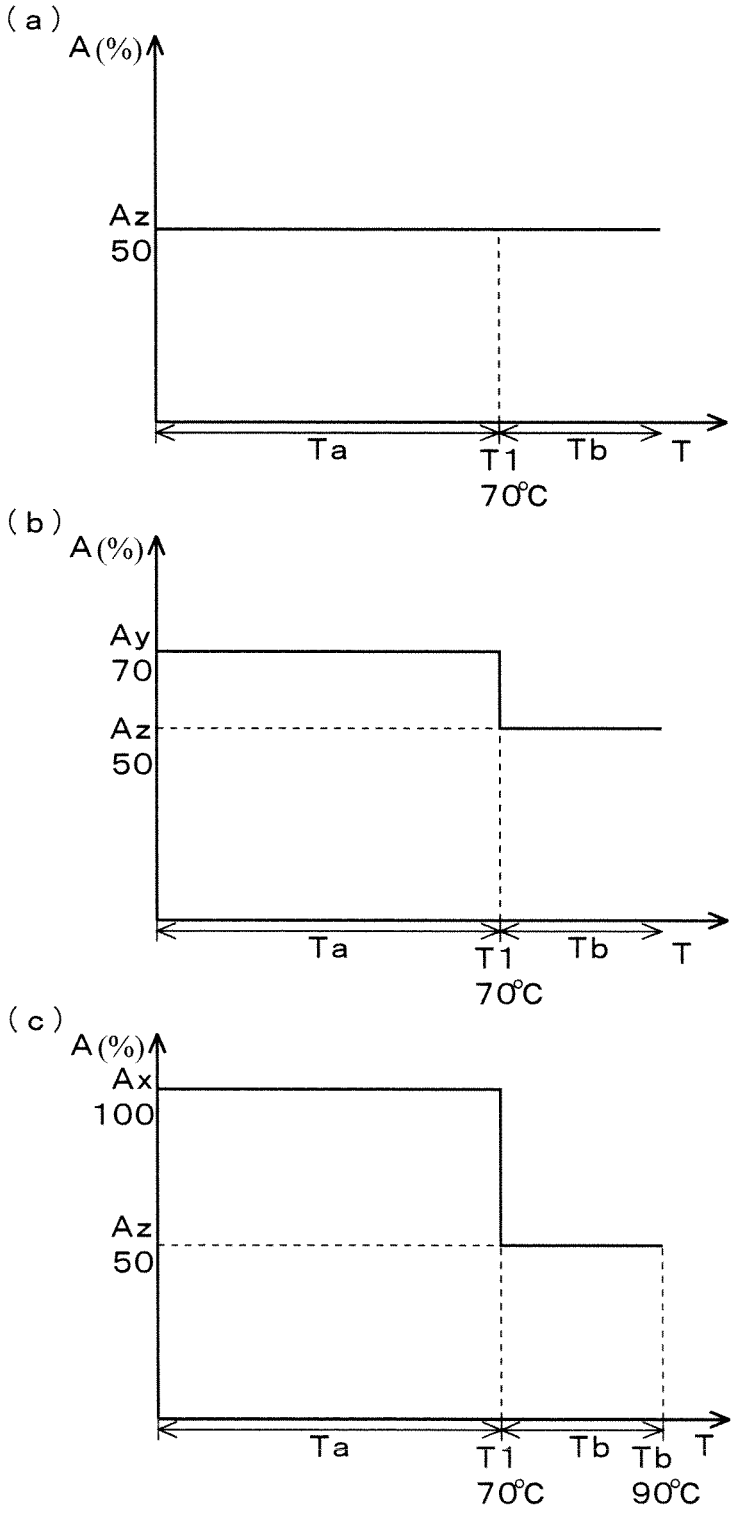

【Fig.9】
| | Ta | Tb |
|---|---|---|
| La | A=50% | A=50% |
| Lb | A=70% | A=50% |
| Lc | A=100% | A=50% |
【Fig.10】
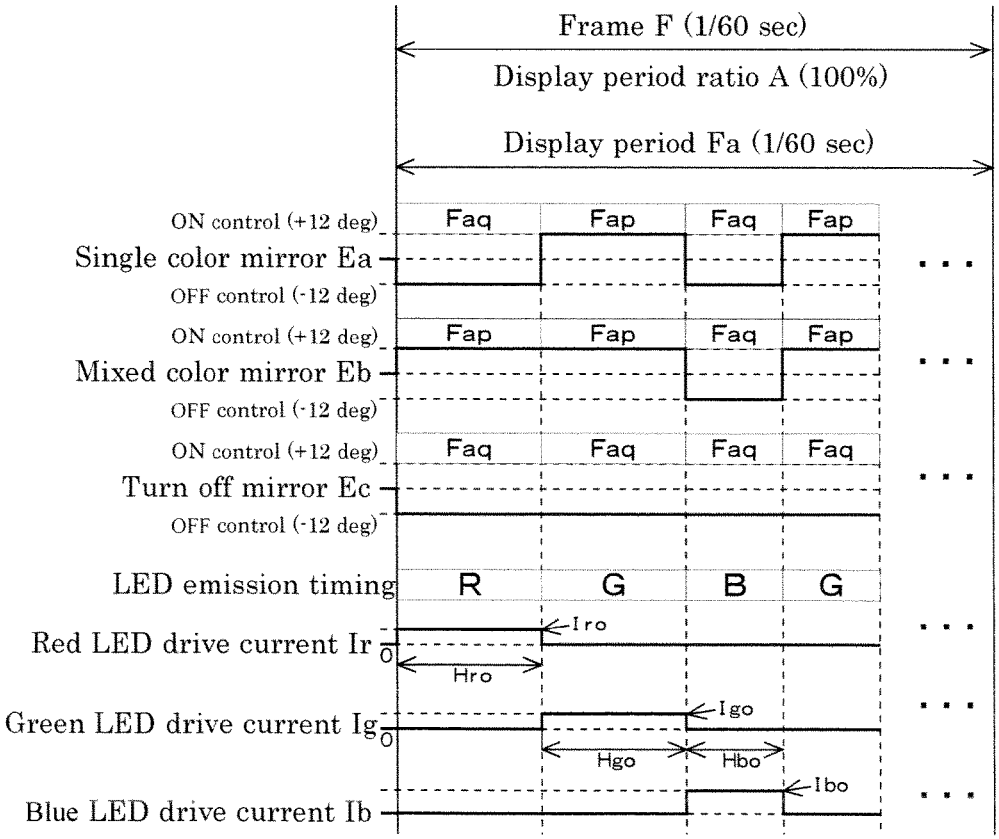

【Fig.11】
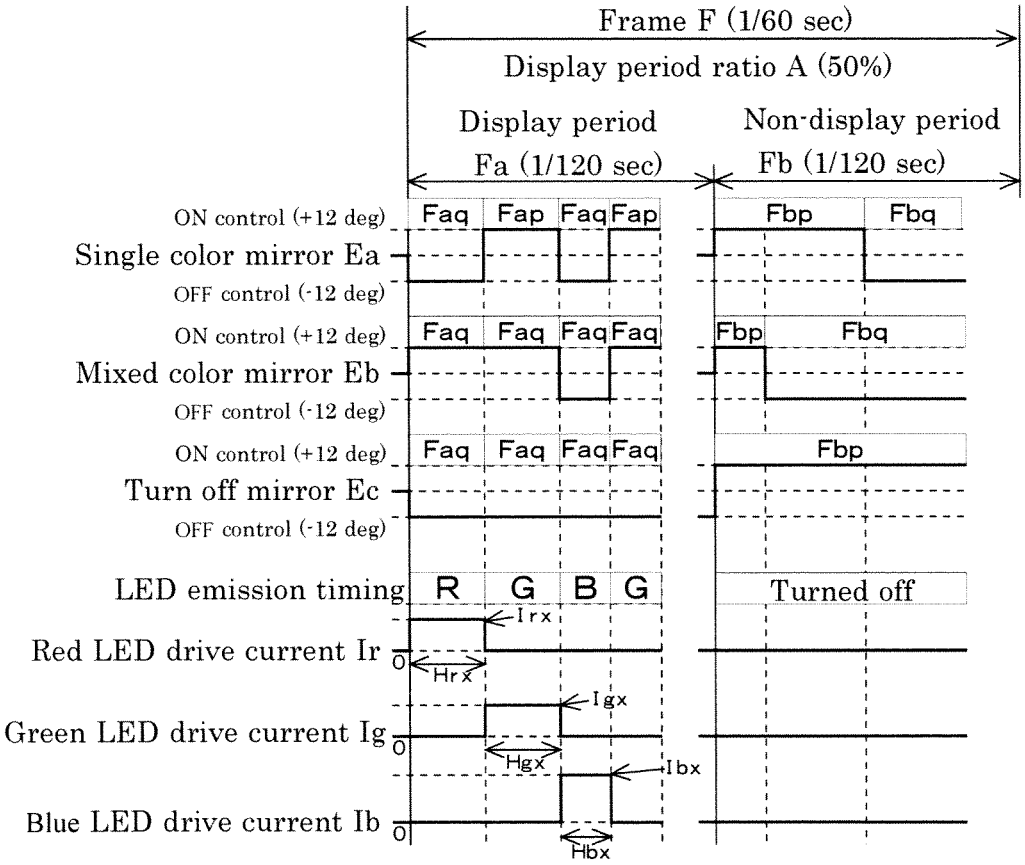

FIELD SEQUENTIAL IMAGE DISPLAY DEVICE

CROSS-REFERENCE TO RELATED APPLICATIONS

The present application is the U.S. National Phase of PCT/JP2013/065525 filed Jun. 5, 2013, which claims priority to Japanese Patent Application No. 2012-149149 filed Jul. 3, 2012. The disclosures of the above applications are incorporated herein by reference.

TECHNICAL FIELD

The present invention relates to a field sequential image display device which displays an image using a field sequential drive method.

BACKGROUND ART

Heretofore, various kinds of vehicular head-up display device, each of which displays a virtual image by projecting a display image on a windshield, or a semi-transmissive plate called a combiner, of a vehicle, has been proposed, and there is one disclosed in, for example, PTL 1. A field sequential image display device 1 is disposed in the dashboard of a vehicle, and a display image D which the field sequential image display device 1 projects is reflected from a windshield 2 to a vehicle operator 3, and the vehicle operator 3 can visually recognize a virtual image V superimposed on a landscape (refer to FIG. 1).

As this kind of vehicular head-up display device, one using a field sequential drive method is proposed by the present applicant, and disclosed in PTL 2.

Such a head-up display device, including illumination portion, formed of a plurality of light emitting elements having different emission colors, which transilluminates a liquid crystal display element; and control portion which controls the luminance of the light emitting elements, carries out an image display using a field sequential drive method whereby the light emitting elements with different emission colors are sequentially turned on, one for each of sub-frames into which is time divided a frame forming an image, and controls the transmittance of the light emitting elements in accordance with the transmittance of the liquid crystal display element, thus substantially uniforming the luminance of light transmissive through the liquid crystal display element.

Also, as an indicator using the field sequential drive method, one using a DMD (Digital Micro-mirror Device) which is a reflective display element is known, and disclosed in PTL 3. Each mirror of the DMD reflects light projected from a light source based on a video signal from the exterior, thus realizing a high resolution display.

CITATION LIST

Patent Literature

PTL 1: JP-A-5-193400
PTL 2: JP-A-2009-109711
PTL 3: JP-A-2002-251163

SUMMARY OF THE INVENTION

Technical Problem

In the DMD which is a reflective display device, however, each mirror of the display element is fixed in a constant state of either ON or OFF, thus leading to an occurrence of an irreversible luminescent spot defect or black spot defect, and thus to a decrease in the life span of the display element, and there is room for improvement in an increase in the life span of the display element.

Therefore, the present invention, bearing in mind the previously described problem, provides a field sequential image display device, wherein it is possible to increase the life span of a display element.

Solution to Problem

The present invention, in order to solve the problems described above, a first aspect of the present invention, a field sequential image display device, comprising: a display element, having a plurality of pixels, which displays a display image; display control portion which controls the plurality of pixels; first illumination portion which illuminates the display element with a first emission color; second illumination portion which illuminates the display element with a second emission color; illumination control portion which drives the first illumination portion and second illumination portion using a field sequential method for each of sub-frames into which a frame of the display image is time divided; and a control unit which controls the display control portion and the illumination control portion based on the display image data, wherein the frame includes: a display period in which the display control portion causes a normal drive of the plurality of pixels, and the illumination control portion drives the first illumination portion and second illumination portion, thereby causing the display element to display the display image; and a non-display period in which the display control portion causes a non-display period drive of the plurality of pixels, and the illumination control portion turns off the first illumination portion and second illumination portion, thereby not causing the display element to display the display image, the control unit lowers a display period ratio, which is a ratio of the display period in the frame period, when reducing luminance of the display image a predetermined luminance threshold value or lower based on a predetermined luminance control condition.

According to such a configuration, it is possible to perform an ON/OFF operation of the pixels of the display element (a mirror) which does not relate to the display image, while displaying the display image with a desired luminance, and it is possible to suppress an occurrence of a luminescent spot defect or black spot defect, caused by that the pixel is fixed in a constant state, and keep the life span of the display element long.

In a second aspect of the present invention, the non-display period drive is such that each of the plurality of pixels is ON/OFF controlled so that an ON period and OFF period of each of the plurality of pixels in the frame are approximately equal to each other.

According to such a configuration, it is possible to suppress burden on the hinge of each pixel (a mirror) of the display element (on the fulcrum of a mirror) from becoming biased in the ON drive and OFF drive, and it is possible to suppress an occurrence of a luminescent spot defect or black spot defect, caused by that the pixel is fixed in a constant state, and keep the life span of the display element long.

In a third aspect of the present invention, the non-display period drive is such that each of the plurality of pixels is ON/OFF controlled in a predetermined cycle.

According to such a configuration, it is possible to suppress an occurrence of a luminescent spot defect or black spot defect, caused by that the pixel is fixed in a constant state, and keep the life span of the display element long.

In a fourth aspect of the present invention, the control unit lowers the display period ratio to approximately half, when reducing the luminance of the display image to the luminance threshold value or lower.

By reducing the display period ratio to approximately half, for example, even for a pixel of display extremely biased to perform 100% ON drive in the display period, it is possible to substantially equalize the ON period and OFF periods in a frame by performing the 100% OFF drive, in the non-display period drive. It is possible to suppress that the burden on the hinge (the fulcrum of a mirror) of each pixel (a mirror) of the display element is biased in the ON drive and OFF drive. It is possible to suppress an occurrence of a luminescent spot defect or black spot defect, caused by that the pixel is fixed in a constant state, and keep the life span of the display element long.

In a fifth aspect of the present invention, the control unit lowers the display period ratio before or after reducing the luminance of the display image to the luminance threshold value or lower.

In a sixth aspect of the present invention, when lowering the display period ratio, the control unit simultaneously changes a drive current value of a driven one of the first illumination portion and second illumination portion, and a drive period to flow the drive current value of the display image, so as to keep the luminance of the display image substantially constant.

According to such a configuration, a luminance change does not occur in the display image when reducing the display period ratio. It is possible to suppress discomfort of the observer caused by the luminance change in the display image by switching of the display period ratio.

In a seventh aspect of the present invention, the field sequential image display device further comprising a temperature detection portion that detects a temperature, and outputs temperature data to the control unit, when the temperature data is a predetermined temperature threshold value or higher, the display period ratio is lowered to approximately half.

According to such a configuration, it is possible to prevent fixation of the pixels of the display element at a high temperature.

In an eighth aspect of the present invention, the field sequential image display device further comprising an illuminance detection portion that measures outside illuminance, and outputs illuminance data to the control unit, when the illuminance data is a predetermined illuminance threshold value or lower, the control unit determines that the luminance control condition is established, and reduces the luminance of the display image to the luminance threshold value or lower.

According to such a configuration, the luminance of a required display image is estimated according to outside illumination, and luminance adjustment is performed based on this. When the illumination is low and the luminance adjustment of the display image is not so necessary, it is possible to perform the non-display period drive, and suppress a bias of the burden on the hinge (the fulcrum of a mirror) of each pixel (a mirror) of the display element in the ON drive and OFF drive, suppress an occurrence of a luminescent spot defect or black spot defect, caused by that the pixel is fixed in a constant state, and keep the life span of the display element long.

Advantageous Effects of the Invention

The present invention provides a field sequential image display device that is able to prolong a life span of a display element.

BRIEF DESCRIPTION OF THE DRAWINGS

FIG. 1 is an overview of an embodiment of the present invention mounted on a vehicle.

FIG. 2 is a conceptual diagram of a field sequential image display device showing the above-mentioned embodiment.

FIG. 3 is a conceptual diagram of an illumination unit that generates illumination light of the above-mentioned embodiment.

FIG. 4 is an explanatory diagram of an electrical configuration of the above-mentioned embodiment.

FIG. 5 is an explanatory diagram of a display period and a non-display period in a display element of the above-mentioned embodiment.

FIG. 6 is a timing chart showing the operation timing of each mirror and LED of the above-mentioned embodiment.

FIG. 7 is a characteristic table that associates luminance L and display period ratio A of a display image D of the above-mentioned embodiment.

FIG. 8 is a characteristic table that associates a temperature T and display period ratio A in each luminance area (La, Lb, Lc) of the above-mentioned embodiment. The luminance area is La in (a), Lb in (b), and Lc in (c).

FIG. 9 is a diagram showing a change in the display period ratio A by the temperature T and luminance L in the above-mentioned embodiment.

FIG. 10 is a timing chart showing the operation timing of each mirror and LED of the above-mentioned embodiment (the display period ratio A is 100%).

FIG. 11 is a timing chart showing the operation timing of each mirror and LED of the above-mentioned embodiment (the display period ratio A is 50%).

DESCRIPTION OF EMBODIMENTS

Hereafter, a description will be given, based on the accompanying drawings, of an embodiment wherein a field sequential image display device of the invention is applied to a vehicular head-up display device.

FIG. 1 is a diagram showing an overview when the field sequential image display device 1 which is an embodiment of the invention is mounted on a vehicle. The field sequential image display device 1, being provided in a dashboard of the vehicle, is such that display light L representing a created display image D is reflected by a windshield 2, thereby causing a vehicle operator 3 to visually recognize a virtual image V of the display image D representing vehicle information. T vehicle operator 3 can visually recognize the virtual image V without turning his/her eyes away from the front.

FIG. 2 is a configuration diagram of the field sequential image display device 1 which is the embodiment of the invention. The field sequential image display device 1 includes an illumination device 10, an illumination optical system 20, a display element 30, a temperature detection portion 40, a projection optical system 50, a screen 60, a plane mirror 70, a concave mirror 71, a housing 80 having a window portion 81 through which the display image D is emitted, an illuminance sensor 82, and a control unit 90.

The illumination device 10 includes illumination portion 11, a circuit substrate 12, formed of an aluminum substrate, on which the illumination portion 11 is mounted, reflection and transmission optical portion 13, and luminance unevenness reduction optical portion 14, as shown in FIG. 3.

The illumination portion 11 is configured of a red diode (first illumination portion) 11 *r* which emits red light R, a green diode (second illumination portion) 11 *g* which emits green light G, and a blue diode (third illumination portion) 11 *b* which emits blue light B.

The reflection and transmission optical portion 13 is formed of a reflecting mirror 13 *a*, which reflects light, and dichroic mirrors 13 *b* and 13 *c*, each configured of a mirror on the surface of which a thin film such as a dielectric multilayer is formed, which carry out transmission and reflection of light.

The reflecting mirror 13 *a*, being disposed at a predetermined angle on a side in a direction in which the red light R emitted from the red LED 11 *r* travels, reflects the red light R.

The dichroic mirror 13 *b*, being disposed at a predetermined angle on a side in a direction in which the green light G emitted from the green LED 11 *g* travels, transmits the red light R reflected by the reflecting mirror 13 *a* and reflects the green light G.

The dichroic mirror 13 *c*, being disposed at a predetermined angle on a side in a direction in which the light B emitted from the blue LED 11 *b* travels, transmits the red light R and green light G transmitted and reflected by the dichroic mirror 13 *b*, and reflects the blue light B.

The luminance unevenness reduction optical portion 14, being formed of a mirror box, an array lens, and the like, reduces the unevenness of light by diffusely reflecting, scattering, and refracting the heretofore described illumination light C. In this way, the illumination device 10 emits the illumination light C in the direction of the illumination optical system 20 to be described hereafter.

The illumination optical system 20, being configured of, for example, a concave lens, adjusts the illumination light C emitted from the illumination device 10 to the size of the display element 30 to be described hereafter.

The display element 30 is formed of a DMD (Digital Micro-mirror Device) including movable micromirrors E, wherein two states ON and OFF are imparted by driving an electrode provided in a lower portion of each micromirror for a very short time of microsecond order, and it is thereby possible to incline the surface of each micromirror at ±12 degrees with its hinge as the fulcrum. Each mirror, when in the ON state, is inclined at +12 degrees with its hinge as the fulcrum, and reflects the illumination light C, emitted from the illumination optical system 20, in the direction of the projection optical system 50 to be described hereafter. Each mirror, when in the OFF state, is inclined at −12 degrees with its hinge as the fulcrum, and does not reflect the illumination light C in the direction of the projection optical system 50. Consequently, the display image D is projected in the direction of the projection optical system 50 by driving each mirror individually.

When the field sequential image display device 1 is powered off, each mirror of the display element 30 is returned to the middle point between the inclination in the ON control and the inclination in the OFF control, and in this embodiment, the drive is stopped at a position of 0 degrees.

The temperature detection portion 40 is configured of a temperature sensor 41, formed of a thermistor or the like incorporated in the ceramic portion of the base substrate of the display element 30, and an A/D converter 42, wherein the temperature sensor 41 measures the temperature of the display element 30, converts analogue data output from the temperature sensor 41 to digital data by the A/D converter 42, and outputs temperature data T to the control unit 90. The A/D converter 42 may be incorporated in the control unit 90.

Also, the temperature sensor 41 may measure the temperature in or around the housing 80 which affects the temperature of the display element 30, rather than measuring the temperature of the display element 30.

Also, the temperature sensor 41 may be disposed on a control substrate (not shown) on which the control unit 90 is mounted, and measure the temperature of the display element 30 remotely from on the control substrate.

The projection optical system 50 is an optical system, configured of, for example, a concave lens or a convex lens, for effectively irradiating the screen 60, to be described hereafter, with the display light L of the display image D projected from the display element 30.

The screen 60, being configured of a diffusion plate, a holographic diffuser, a microlens array, and the like, receives on the lower surface the display light L from the projection optical system 50, and displays the display image D on the upper surface.

The plane mirror 70 reflects the display image D) displayed on the screen 60 toward the concave mirror 71 to be described hereafter.

The concave mirror 71, being a concave mirror, or the like, by reflecting from the concave surface the display light L reflected by the plane mirror 70, emits the reflected light toward the window portion 81 to be described hereafter. By so doing, the formed virtual image V increases to a size to which the display image D displayed on the screen 60 is enlarged.

The housing 80, being formed from hard resin or the like, is formed into a box including the window portion 81 of a predetermined size in an upper portion. The housing 80 houses in predetermined positions the illumination device 10, illumination optical system 20, display element 30, temperature detection portion 40, projection optical system 50, screen 60, plane mirror 70, concave mirror 71, and the like.

The window portion 81, being formed in a curved shape from translucent resin such as acrylic resin, is mounted in an opening portion of the housing 80 by welding or the like. The window portion 81 transmits the light reflected from the concave mirror 71.

The illuminance sensor 82, being arranged inside the window portion 81 at a position exposed to external light, measures illuminance by external light, and outputs illuminance data to the control unit 90. Based on the illuminance data from the illuminance sensor 82, the control unit 90 controls the illumination portion 11 through the illumination control unit 91, or controls the display element 30 through the display control unit 92, thereby adjusting the luminance of the display image D. Opportunity for the control unit 90 to adjust the luminance L of the display image D may be, a luminance switching signal from a vehicle or a luminance adjustment operation signal from a vehicle operator, other than the illuminance data from the illuminance sensor 82 as described above.

Next, a description will be given, using FIG. 4, of an electrical configuration of the field sequential image display device 1. FIG. 4 is an electrical configuration illustration of the field sequential image display device 1 of this embodiment.

The control unit 90, being configured of a peripheral circuit such as a microcomputer and external interface, RAM, and ROM, is such that a video signal 300 for displaying the display image D is input from a vehicle ECU 4 by an LVDS (Low Voltage Differential Signal) communication or the like, and illumination control data 310 for controlling the illumination device 10 at a light luminance and emission timing required by the video signal 300, and furthermore, display control data 320 for causing the display element 30 to display the display image D required by the previously mentioned video signal 300, are output respectively to an illumination control unit 91 and a display control unit 92, thereby controlling the output operation of the display image D in the field sequential image display device 1.

A frame F which is a cycle in which the display image D is displayed is configured of sub-frames SF wherein the frame F is divided into a plurality of time periods.

The illumination control unit 91 controls the illumination device 10 using a field sequential drive method which causes the light emitting diodes 11 *r*, 11 *g*, and 11 *b* of different colors to switch sequentially, one for each of the previously mentioned sub-frames SF, at high speed at a light intensity and timing required by the illumination control data 310.

The display control unit 92, based on the display control data 320, ON/OFF controls each mirror of the display element 30 using a PWM method (by changing an ON time ratio) or the like, and reflects the lights R, G, and B, emitted from the illumination device 10, in the direction of the screen 60, thereby depicting the display image D in full color utilizing colors mixed by an additive mixing method with the light emitting diodes 11 *r*, 11 *g*, and 11 *b* as basic colors.

To give a simple description of an operation of the field sequential display device 1 of the above configuration, (1) The control unit 90 creates the illumination control data 310 and display control data 320 based on the video signal 300 from the exterior.

(2) The illumination device 10, based on the illumination control data 310, emits the illumination light C to the display element 30 using the field sequential drive method.

(3) The display element 30, based on the display control data 320, ON/OFF controls each mirror of the display element 30, thereby projecting the illumination light C from the illumination device 10 toward the screen 60) as the display image D.

(4) The display light L representing the display image D displayed on the screen 60 is reflected toward the concave mirror 71 by the plane mirror 70.

(5) The display image D is enlarged to a predetermined size by the concave mirror 71, the display light L representing the enlarged display image D is reflected by the windshield 2, and the virtual image V of the display image D is thereby formed on the front of the windshield 2. In this way, the field sequential display device 1 enables the vehicle operator 3 to visually recognize the display image D as the virtual image V.

Hereafter, a description will be given of a control method of the field sequential image display device 1 with reference to FIGS. 5 and 6. FIG. 5 is an explanatory diagram of the non-display period drive, which is a characteristic part of the invention. FIG. 6 is a time chart schematic diagram of the field sequential drive of the field sequential image display device 1.

The frame F includes, as shown in FIG. 5, a display period Fa in which each mirror E of the display element 30 is normally driven, and a non-display period Fb in which the non-display period drive is performed. In the description of this embodiment, the ratio of the display period Fa in the frame F is described as a display period ratio A, a period in which the mirror E performs ON drive in the display period Fa is described as an ON drive period in display period Fap, a period in which the mirror E performs OFF drive is described as an ON drive period in non-display period Faq, a period in which the mirror E performs ON drive in the non-display period Fb is described as an ON drive period in non-display period Fbp, a period in which the mirror E performs OFF drive is described as an ON drive period in non-display period Fbq, a total period of ON drive in the frame F (the sum of the ON drive period in display period Fap and ON drive period in non-display period Fbp) is described as a total ON drive period Fp, and a total period of OFF drive in the frame F (the sum of the OFF drive period in display period Faq and OFF drive period in non-display period Fbq) is described as a total OFF drive period Fq.

The display period Fa is a period in which the illumination device 10, based on the illumination control data 310, emits the illumination light C in the direction of the display element 30, and the display element 30, based on the display control data 320, ON/OFF controls each mirror of the display element 30, thereby projecting the illumination light C from the illumination device 10 toward the screen 60 as the display image D.

In the non-display period Fb, the non-display period drive, which turns off the illumination device 10, and ON/OFF controls each mirror of the display element 30 at a predetermined timing, is carried out.

The non-display period drive is such that each mirror of the display element 30 is ON/OFF controlled so that the ON period and OFF periods of each mirror E in the frame F becomes substantially equal.

Explaining specifically with reference to FIG. 5, the control unit 90 adjusts the ON drive period in non-display period Fbp and OFF drive period in non-display period Fbq for the non-display period drive, so that the sum of the ON drive period in the display period Fap and ON drive period in non-display period Fbp (the total ON drive period Fp) becomes substantially equal to the sum of the OFF drive period in display period Faq and OFF drive period in non-display period Fbq.

Explaining in detail with reference to the timing chart of FIG. 6, in a predetermined frame F, for example, there are a monochromatic mirror Ea that displays green, a mixed color mirror Eb that displays a mixed color of red and green, and an off mirror that displays no colors. In the display period Fa, the monochromatic mirror Ea is ON controlled only at the timing of lighting the green LED 11*g*, based on the display control data 320. In the non-display period Fb, the control unit 90 adjusts the ON drive period in non-display period Fbp and OFF drive period in non-display period Fbq in the non-display period Fb, so that the total ON drive period Fp, which is the sum of the periods of ON drive periods in the frame F, becomes approximately half of the frame F, and causes the monochromatic mirror Ea to perform non-display period drive, based on the ON drive period in non-display period Fbp and OFF drive period in non-display period Fbq.

The non-display period drive, like the monochromatic mirror Ea, continues the ON drive in the non-display period Fb for the predetermined ON drive period in non-display period Fbp, then, continues the OFF drive for the predetermined ON drive period in non-display period Fbp. Further, the non-display period drive, like the mixed color Eb, may repeat the ON drive and OFF drive in the non-display period Fb, and repeats the ON drive and OFF drive in a cycle conforming to the ON drive period in non-display period Fbp and ON drive period in non-display period Fbp. Incidentally the off mirror Ec always performs OFF drive in the display period Fa, and the non-display period drive becomes the control to perform ON drive always in the non-display period Fb.

The display period ratio A that is the ratio of the display period Fa in the frame F is 50% in FIG. 6. The control unit 90 switches the display period ratio A depending on what luminance L to display the display image D as shown in FIG. 7.

The control unit 90 sets the display period ratio A to 50% when displaying the display image D with luminance lower than the first luminance threshold value L1 (luminance area La). The control unit 90 sets the display period ratio A to 70% when the luminance L of the display image D is between the first luminance threshold value L1 and second luminance threshold value L2 (a luminance area Lb), and sets the display period ratio A to 100% when the luminance L of the display image D is the second luminance threshold value L2 or higher. In this way, when the luminance L that the control unit 90 intends to display the display image D can be achieved even by reducing the display period Fa, by increasing the non-display period Fb in the frame F, it is possible to make adjustment to substantially equalize the total ON drive period Fp and total OFF drive period Fq in the frame F while keeping the luminance L of the display image D at a luminance level desired by the control unit 90. This prevents the mirror E of the display element from being fixed in a constant state of either ON or OFF, and prolongs the life space of the display element.

Further, when the temperature Td of the display element 30 is entered from the temperature sensor 40 and the temperature Td rises to the predetermined temperature threshold value T1 or higher (a temperature area Tb), the control unit 90 decreases the display period ratio A to 50% or lower as shown in FIG. 8.

FIG. 8 (*a*) shows the case where the luminance area is the first luminance area La. When the luminance L is in the first luminance area La, the display period ratio A is maintained at 50% in all temperature ranges. FIG. 8 (*b*) shows the case where the luminance area is the second luminance area Lb. When the temperature T rises to the temperature threshold value T1 or higher, the control unit 90 changes the display period ratio A to 50% from 70%. FIG. 8 (*c*) shows the case where the luminance area is the third luminance area Lc. When the temperature T rises to the temperature threshold value T1 or higher, the control unit 90 changes the display period ratio A to 50% from 100%.

In other words, as shown in FIG. 9, the display period ratio A is changed to 50% when the temperature T is in the temperature area Tb, and changed to 50% when the luminance L is in the luminance area La.

The control unit 90 lowers the display period ratio A before reducing the luminance L to the luminance threshold value or lower.

Explaining specifically, when the display period ratio A is changed to 50% as shown in FIG. 11 from 100% as shown in FIG. 10, the drive current value (Iro, Igo, Ibo) of the illumination portion 10 and the drive period (Irx, Igx, Ibx) to flow the drive current are simultaneously changed, the drive current value (Irx, Igx, Ibx) and the drive period to flow the drive current (Hrx, Hgx, Hbx) are adjusted, and the display period ratio A is changed. As the display period ratio A is reduced (50% from 100%), the display period Fa is reduced. The drive current value I of LED 11 is increased to compensate for the decrease of the display period Fa. According to such a configuration, it is possible to maintain the luminance L of the display image D even when the display period ratio A is reduced, and suppress discomfort of the observer caused by the luminance change in the display image D (virtual image V) by the change of the display period ratio A. The control unit 90 may lower the display period ratio A after reducing the luminance L of the display image D to the luminance threshold value or lower.

With the aforementioned configuration, the field sequential image display device 1 of the invention measures outside illuminance by the illuminance sensor 82. Based on the illuminance data, the control unit 90 controls the illumination control unit 91 and display control unit 92, thereby adjusting the luminance L of the display image D. When the luminance L of the display image D indicated by the control unit 90 is the first luminance threshold value L1 or lower, the display period ratio A is set to 50%. According to such a configuration, it is possible to suppress that the burden on the hinge of each mirror E of the display element 30 is biased in the ON drive and OFF drive, suppress an occurrence of luminescent spot defect or black spot defect caused by fixation of a pixel in a certain constant state, and keep the life space of the display element long.

INDUSTRIAL APPLICABILITY

The field sequential image display device according to the present invention is applicable as a head-up display device, which irradiates display light representing an image to a windshield of an automobile, for example, and causes a driver to visually recognize a virtual image superimposed on a landscape.

DESCRIPTION OF REFERENCE NUMERALS

1 Field sequential display device
2 Windshield
3 Vehicle operator eye
10 Illumination device
11 Illumination portion
11 *r* Red LED (First illumination portion)
11 *g* Green LED (Second illumination portion)
11 *b* Blue LED (Third illumination portion)
12 Circuit substrate
13 Reflection and transmission optical portion
13 *a* Reflecting plate
13 *b* Dichroic mirror
13 *c* Dichroic mirror
14 Luminance unevenness reduction optical portion
20 Illumination optical system
30 DMD (Display element)
40 Temperature detection portion
41 Temperature sensor
42 A/D converter
50 Projection optical system
60 Screen
70 Plane mirror
71 Concave mirror
80 Housing
81 Window portion
82 Illuminance sensor
90 Control unit
91 Illumination control unit
92 Display control unit
300 Video signal
310 Illumination control data
320 Display control data
R Red light
G Green light
B Blue light

The invention claimed is:

1. A field sequential image display device, comprising:

a display element, having a plurality of pixels, which displays a display image;

a display controller which controls the plurality of pixels;

a first light source which illuminates the display element with a first emission color;

a second light source which illuminates the display element with a second emission color;

an illumination controller which drives the first light source and the second light source using a field sequential method for each of sub-frames into which a frame of the display image is time divided;

a control unit which controls the display controller and the illumination controller based on display image data; and a temperature detector that detects a temperature and outputs temperature data to the control unit, wherein the frame includes:

a display period in which the display controller causes the plurality of pixels to be turned on and/off in accordance with a first normal drive mode, and the illumination controller drives the first light source and the second light source based on illumination control data, thereby causing the display element to display the display image; and a non-display period which is a remaining period of a frame period other than the display period and in which the display controller causes the plurality of pixels to be turned on and off in accordance with a second non-display drive mode, and the illumination controller turns off the first light source and the second light source, thereby not causing the display element to display the display image, the control unit lowers a display period ratio, which is a ratio of the display period to the frame period, and reduces luminance of the display image based on a predetermined luminance control condition, when the temperature detected by the temperature detector is equal to or higher than a predetermined temperature threshold value, the control unit lowers the display period ratio to 50% or lower, not based on luminance of the display image, and when the temperature detected by the temperature detector is lower than a predetermined temperature threshold value, the control unit controls the display period ratio based on the luminance of the display image.

2. The field sequential image display device according to claim 1, wherein in the second non-display drive mode, the display controller controls each of the plurality of pixels ON/OFF so that an ON period and OFF period of each of the plurality of pixels in the frame are approximately equal to each other.

3. The field sequential image display device according to claim 1, wherein in the second non-display drive mode, the display controller controls each of the plurality of pixels ON/OFF controlled in a predetermined cycle.

4. The field sequential image display device according to claim 1, wherein the control unit lowers the display period ratio to approximately half and reduces the luminance of the display image.

5. The field sequential image display device according to claim 1, wherein the control unit lowers the display period ratio before or after the control unit reduces the luminance of the display image.

6. The field sequential image display device according to claim 1, wherein when lowering the display period ratio, the control unit simultaneously changes a drive current value of a driven one of the first light source and the second light source, and a drive period to flow the drive current value of the display image, so as to keep the luminance of the display image substantially constant.

7. The field sequential image display device according to claim 1, further comprising an illuminance detector that measures outside illuminance, wherein, when the outside illuminance measured is equal to or lower than a predetermined illuminance threshold value, the control unit determines that the luminance control condition is established and reduces the luminance of the display image.

* * * * *